US005878988A

United States Patent [19]

Rakower

[11] Patent Number: 5,878,988

[45] Date of Patent: Mar. 9, 1999

[54] MOUNTING BRACKET AND METHOD

[76] Inventor: Joel A. Rakower, 9 Tomkins Ct., Commack, N.Y. 11725

[21] Appl. No.: 881,161

[22] Filed: Jun. 24, 1997

[51] Int. Cl.[6] ..... A47G 1/16

[52] U.S. Cl. ..... 248/497; 248/489

[58] Field of Search ..... 248/71, 74.1, 74.2, 248/301, 305, 306, 316.7, 489, 493, 497, 547; 411/457, 469; 16/250, 251

[56] References Cited

U.S. PATENT DOCUMENTS

| | | | |
|---|---|---|---|
| D. 29,565 | 11/1898 | Hirsh . | |
| D. 273,273 | 4/1984 | Faidide . | |
| D. 299,003 | 12/1988 | Fadeley, Jr. . | |
| D. 346,952 | 5/1994 | Keller . | |
| 1,999,575 | 4/1935 | Reuter et al. | 248/497 |
| 2,241,657 | 5/1941 | Dehring | 248/71 |
| 2,317,368 | 4/1943 | Frey . | |
| 2,334,700 | 11/1943 | Frey . | |
| 2,464,295 | 3/1949 | Edgar | 248/489 |
| 2,948,940 | 8/1960 | Degener | 248/74.2 |
| 4,547,009 | 10/1985 | Allen | 16/251 |
| 4,679,754 | 7/1987 | Richards | 248/71 |
| 4,821,992 | 4/1989 | Johnson | 248/497 |
| 5,201,484 | 4/1993 | Thoen | 248/71 |
| 5,507,462 | 4/1996 | Hickey | 248/493 |
| 5,639,049 | 6/1997 | Jennings et al. | 248/74.2 |

*Primary Examiner*—Leslie A. Braun
*Assistant Examiner*—Robert Lipcsik
*Attorney, Agent, or Firm*—Hoffman, Wasson & Citler

[57] ABSTRACT

A mounting bracket including a base which accommodates more than one fastener. A latch mounted on the base that discourages removal of the fasteners from the base. The latch cooperates with the base to define a capture zone that selectable secures the wire of a picture or like article. The base also includes a catch which may retain the latch from cooperating with the base to capture a wire. The base further includes a marking element which may be used to mark a position on a wall. Methods of mounting and hanging articles also are disclosed.

10 Claims, 5 Drawing Sheets

MOUNTING BRACKET AND METHOD

BACKGROUND OF THE INVENTION

1. Field of the Invention

The present invention relates to brackets. More specifically, the present invention relates to brackets for hanging articles, such as pictures.

2. Description of the Prior Art

Hanging articles, such as pictures, typically involves affixing a wire or cord to the picture, or frame in which it is mounted, mounting a picture hook on a wall and placing the wire in the hook. Prior to the instant invention, hook devices were unsatisfactory, especially where the articles were hung in areas subject to unauthorized removal or violent structural activities. Specifically, articles hung with prior art hook devices were at risk to theft and damage from earthquakes. Accordingly, articles so suspended either would be lost or damaged.

Many prior art hook devices have attempted to provide a lock to secure an article. For example, U.S. Pat. No. 2,334,700, issued Nov. 23, 1943, to L. E. Frey, describes a picture hook with an entrapping lip portion. Referring to FIG. 1, the device includes a loop 16 with a turned over portion 21 and a wedge-shaped portion 19. A wire may be trapped within the slot 22 defined by portions 21 and 19. This locking feature may deter the wire from slipping relative to the hook, but does not discourage removal of the wire altogether.

U.S. Pat. No. 2,317,368, issued Apr. 27, 1943, to L. E. Frey, describes a picture hook also providing a slot for wedging a wire, discouraging it from slipping. Referring to FIG. 3, the slot 13 is defined by wedged portions 15.

U.S. Pat. No. Des. 299,003, issued Dec. 20, 1988, to H. J. Fadeley, Jr., shows a picture hanger with inter-digitated fingers. Referring to FIG. 8, a wire may be slipped down along the downwardly-extending finger until it is received and squeezed by two upwardly-extending fingers. As with the above inventions, this invention seems to deter a wire from slipping, but does not deter its ultimate removal from the hook.

U.S. Pat. No. Des. 346,952, issued May 17, 1994, to F. Keller, shows a combined animal attaching bracket and feed bucket holder which discourages removal of an item from the device. Referring to FIG. 4, a wire may be fed up through a slot defined by the outer, downwardly-extending exterior finger and an interior, upwardly-extending finger. The wire then may be caused to rest within the slot defined by the inner surface of the interior, upwardly-extending finger and an inner, downwardly-extending finger. This device may deter the inadertent removal of wire-like items, however would not discourage one determined to do so.

Some prior art devices provide effective article-locking mechanisms. However, these devices do not provide for mounting the device to a conventional surface such as a wall. For example, U.S. Pat. No. Des. 273,273, issued Apr. 3, 1984, to C. Faidide, shows a simple hook with a latch. Referring to FIG. 2, the device has a main J-shaped hook with a pivotable latch which may be trapped under the lip of the hook.

Other prior art devices provide mechanisms for retaining an object within the device and a wall-attachment mechanism; however, the wall attachment mechanism does not assure that the device remains attached to the mounting service. For example, U.S. Pat. No. Des. 29,565, shows a hat hook shell. Referring to FIG. 2, the device provides a base A and a spring-loaded latch G which cooperate to frictionally engage an item inserted between the end of the latch G and the lip E. The device also has mounting apertures D which accommodate fasteners, which assume a parallel penetration direction, to maintain the device onto the mounting surface.

Clearly, the above demonstrates a need for a mounting bracket including a mechanism for discouraging removal of an article therefrom and a mechanism for discouraging removal of the bracket itself from a mounting surface.

None of the above references, taken alone or in combination, are seen as teaching or suggesting the presently claimed mounting bracket.

SUMMARY OF THE INVENTION

The present invention overcomes the limitations of the above inventions by providing a mounting bracket including a mechanism which may be selectably enabled to discourage removal of items therefrom and a mechanism which discourages removal of the present invention from a mounting surface. The present invention includes a base that may accommodate more than one fastener. The base has a hook into which a wire may be placed. The present invention also includes a latch mounted on the base that discourages removal of the fastener from the base. The latch extends from the base to the interior lip of the hook, cooperating with the base to define a capture zone. The latch may be diverted into the capture zone, but is retained by the hook such that an article may not be withdrawn from the capture zone. The base also includes a catch which may be used to retain the latch from abutting the inner lip of the hook. The base also includes a marking element which extends from the base and may be used to mark a position on a wall.

In consideration of the above, a first object of the invention is to provide a mounting bracket that is easy to install on a mounting surface.

A second object of the invention is to provide a mounting bracket that accommodates a wire or cord for hanging an article.

A third object of the invention is to provide a mounting bracket that accommodates and maintains more than one fastener such that the fasteners discourage removal of the present invention from the mounting surface.

A fourth object of the invention is to provide a mounting bracket that includes a latch which permits capturing a wire or cord for hanging an article and discourages removal of same.

A fifth object of the invention is to provide a mounting bracket with a mechanism for selectively disabling the above-identified latch.

A sixth object of the invention is to provide a mounting bracket that includes a marker for identifying a mounting point on a mounting surface.

A seventh object of the invention is to provide a mounting bracket with improved elements and arrangements thereof, in an apparatus for the purposes described which is inexpensive, dependable and effective in accomplishing its intended purposes.

These and other objects of the present invention will become readily apparent upon further review of the following specification and drawings.

BRIEF DESCRIPTION OF THE DRAWINGS

Similar reference characters denote corresponding features of the invention consistently throughout the attached drawings.

DETAILED DESCRIPTION OF THE PREFERRED EMBODIMENTS

Figure 2:
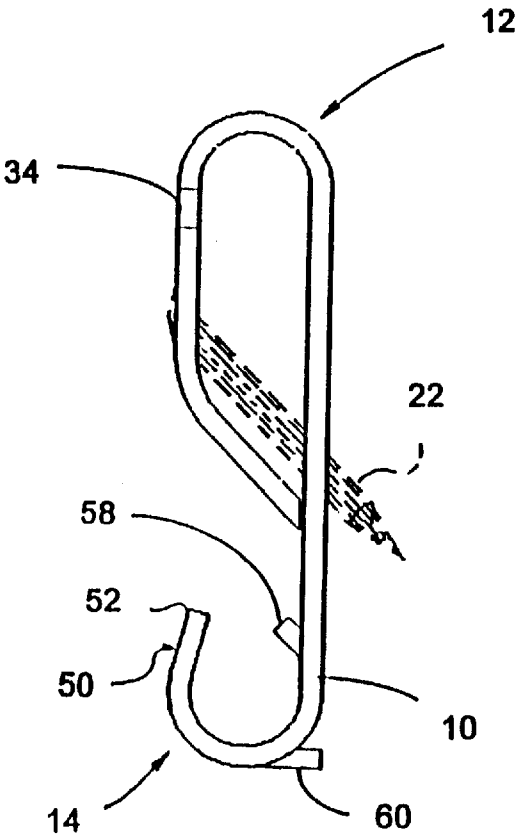
FIG. 2 is a right side elevational view of the embodiment shown in FIG. 1, the fastener shown in ghost lines for illustration purposes only.
Figure 1:
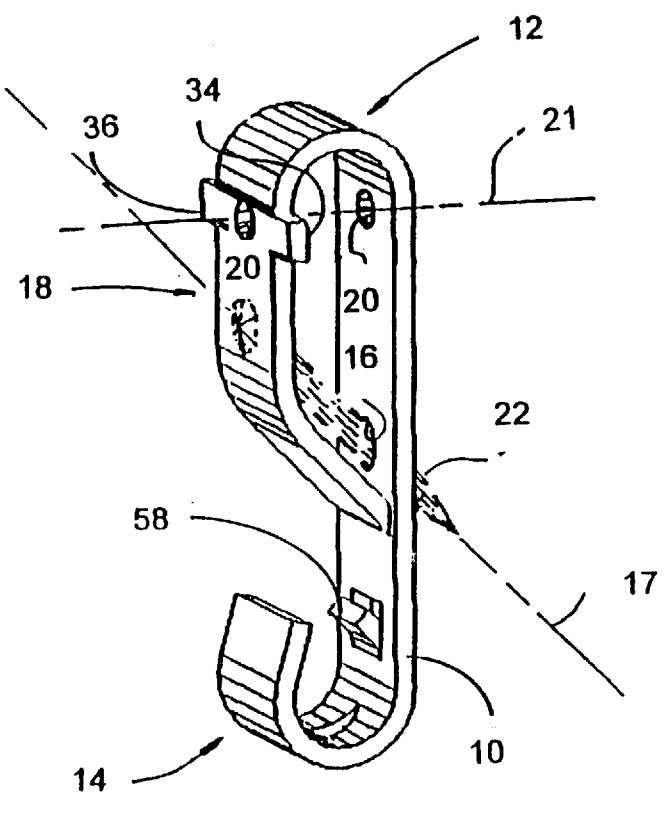
FIG. 1 is a top right front perspective view of the invention without the latch element, the fastener shown in ghost lines for illustration purposes only.

Referring to FIGS. 1 and 2, the present invention includes a base 10 with an upper end 12 and a lower or distal end 14. The upper end 12 of the base 10 is configured to accommodate at least one fastener 22. The fastener 22 is shown for illustration purposes only, and is not a constituent part of the invention. Preferably, the base 10 accommodates a fastener with an opening having a central axis, or series of openings 16 with coincident central axes 17 as shown. Although the upper end 12 of the base 10 is shown having a doubled over portion 18, this particular structure is not critical to the functioning of the invention, rather represents one mode for executing the present invention. The invention may include an entirely solid upper portion 12, or other means, for performing substantially the same function of accommodating and maintaining at least one fastener.

The base 10 accommodates and maintains at least one fastener at a predetermined orientation. The base also may include means for accommodating other fasteners, such as the openings 20 having coincident central axes 21.

Figure 5:
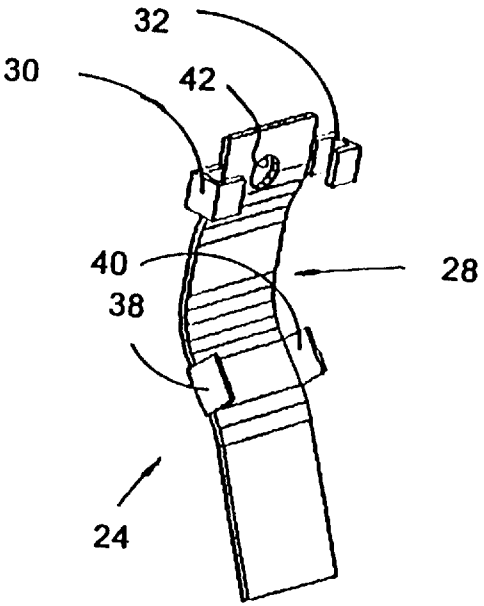
FIG. 5 is a top right rear perspective view of the embodiment shown in FIG. 3.
Figure 4:
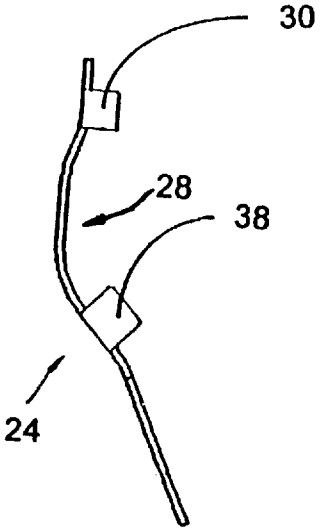
FIG. 4 is a right side elevational view of the embodiment shown in FIG. 3.
Figure 3:
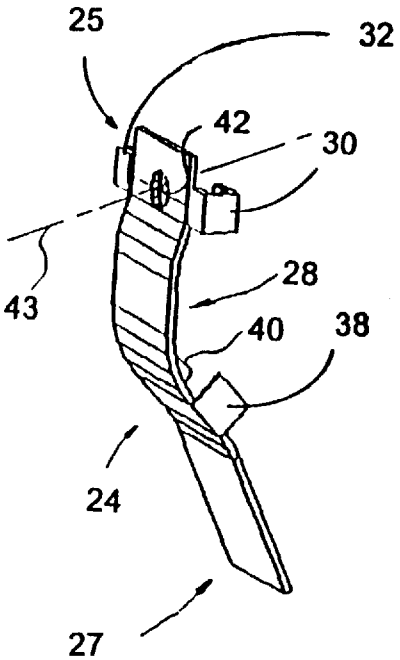
FIG. 3 is a top right front perspective view of the latch of the present invention.
Figure 7:
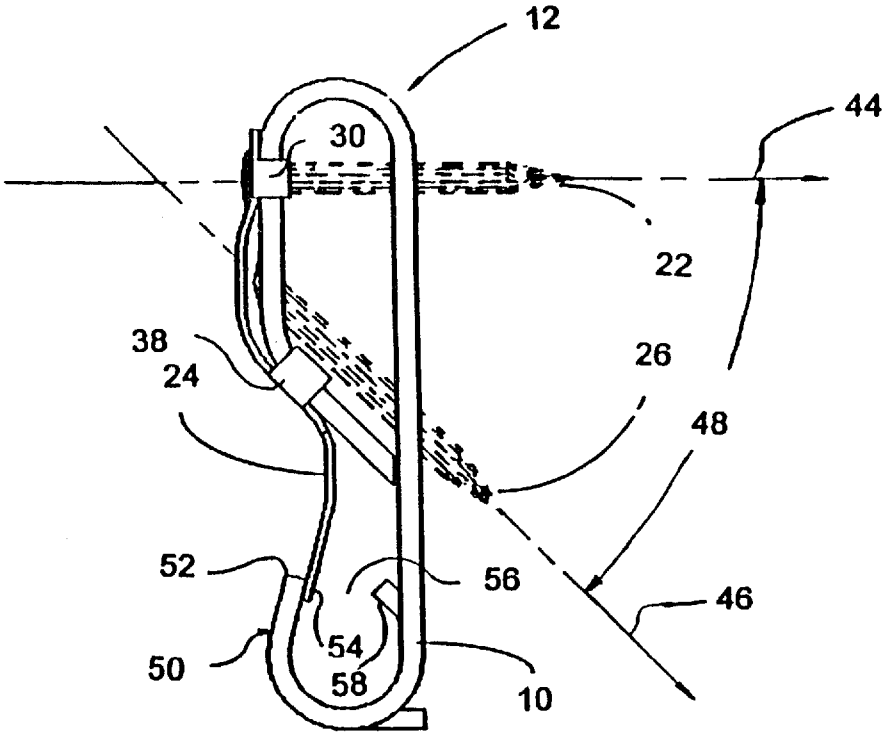
FIG. 7 is a right side elevational view of the embodiment shown in FIG. 6, the fastener shown in ghost lines for illustration purposes only.
Figure 6:
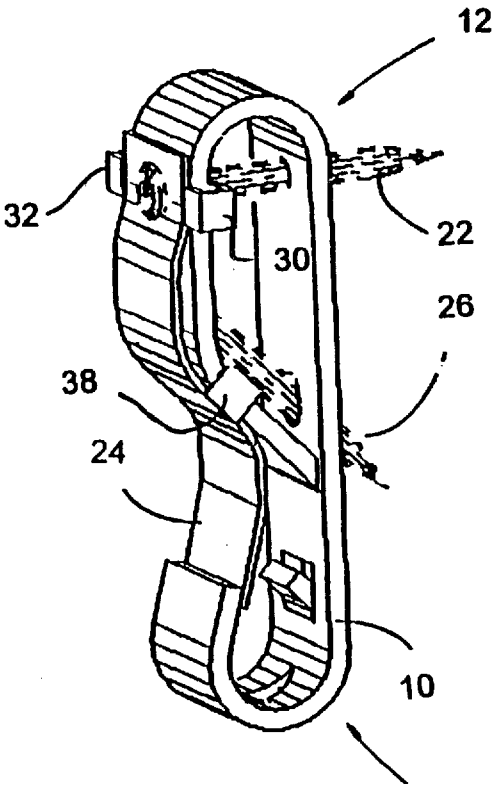
FIG. 6 is a top right front perspective view of the present invention, the fastener shown in ghost lines for illustration purposes only.

Referring to FIGS. 3–5, the invention also includes a latch 24 having a first end 25 and a second end 27. Referring also to FIGS. 6 and 7, the latch 24 is mounted on the base 10. As best seen in FIG. 7, the latch 24 is configured and mounted so that the fastener 22 is not able to back out of its respective openings in the base. In FIGS. 3–5, the latch is shown having a curvature, in the area indicated generally by the numeral 28, which accommodates the head of the fastener 26. This curvature 28 is not intended to be the only means for securing the fastener 26. The embodiment shown represents what is considered to be the easiest way to accomplish this function of the invention. Any other means for preventing a fastener from backing out from, or releasing its hold on, the base is considered within the scope of this invention.

In order to insure that the latch is not rotatable or otherwise dislodgable from its intended design position with respect to the base, the latch includes a first set of side flaps 30 and 32. As shown in FIG. 6, the first set of flaps 30 and 32 envelop the two extensions 34 and 36 of the base 10, as shown in FIG. 1. The latch 24 also includes a second set of side flaps 38 and 40. Referring again to FIG. 6, the side flaps 38 and 40 do not necessarily envelop any portion of the base, however are configured so as to maintain the base between the flaps.

The first and second sets of side flaps of the latch 24 are not critical to operation of the invention. These are provided as a means for assuring that the latch is not dislodgable from its operating position. The invention is intended to embrace any means that maintain the latch in the designed position.

As used herein, the term "maintain" means fixed in a demountable or detachable manner. In the above case, the latch may be maintained on the base by the first and second set of side flaps, that is the latch may attach to the base, however, is not permanently fixed thereto, and may be removed. The term "maintain" is distinguished from the term "secure." The term "secure," as used herein, refers to substantially permanent maintaining of an element. For example, referring to FIG. 7, the base alone maintains the fastener 26. However, when the latch 24 is mounted on the base, the fastener 26 is secured, and not removable from, the base. The latch itself may be removed, thus only is maintained on the base, however the fastener 26 is secured and not just maintained.

Referring again to FIGS. 3–5, the latch 24 also is configured to accommodate a fastener or fastening means. As shown, the means for accommodating a fastener is accomplished with an opening 42 having a central axis 43. Referring also to FIGS. 6 and 7, the ability of a latch 24 to accommodate a fastener allows it to be secured on the base 10. Such may be accomplished where the base 10 has openings 20 in registry with the opening 42 of the latch 24. In this case, a fastener 26 is received in the openings 42 and 20 such that the latch 24 is not able to slide relative to the base.

Another novel feature of the present invention is that it may be not only maintained, but secured on a mounting surface. Again, for the sake of clarity, maintaining means that the present invention may be removed from the surface, whereas securing means that it may not be removed. The securing feature of the present invention is achieved by configuring the base 10 to encourage penetration of more than one fastener into the mounting surface at diverse angles to one another. As best seen in FIG. 7, each fastener 22 and 26 has respective penetration directions 44 and 46 respectively. The fasteners or fastening means assume an angle of penetration relative to the base. The base openings 16 receive fastener 26 such that axes 17 and 46 are coincident, and openings 20 receive fastener 22 such that axes 21 and 44 are coincident. The base maintains at least one fastener with a penetration direction which is unique. The term "unique" means that the penetration angle of the subject fastener is different relative to any other fastener. For clarity, the absolute angle of the penetration direction of the subject fastener, as measured, for example, relative to a mounting surface, is different from the absolute angle of the penetration direction of any other fastener. Referring to the example shown in FIG. 7, this convention causes the penetration directions 44 and 46, thus the fasteners 22 and 26, to define an angle 48. In the event that the fasteners 22 and 26 are driven into a mounting surface parallel to each other, assuming parallel penetration directions 44 and 46, the angle 48 equals zero. This particular mounting convention is disclosed in U.S. Pat. No. Des. 29,565. The pronounced angle

48 shown in FIG. 7 demonstrates that the present invention is intended to embrace driving conventions where the angle 48 is greater than zero. The preferred embodiment provides for an angle 48 of approximately 45°. The invention is not intended to be limited to 45°, rather any angle 48 which operates to secure the base to the mounting surface. Also, the present invention is not intended to be limited to angles 48 that only are greater than zero.

Theoretically, where the angle 48 is greater than zero, the fasteners secure the base to the mounting surface. When force is applied to the base away from the mounting surface, the fasteners are urged against the walls of the bore created in the mounting surface (not shown) and, presuming the mounting surface is sufficiently strong, does not permit the fastener to be drawn through the wall of the bore created, thus wedging the fastener and base in place. This securing convention is particularly effective in cases where earthquakes violently shake a structure and, under the weight of an article hung, such as a valuable painting, vibrate the fasteners. The wedging action of the driving convention does not permit the fasteners to be shaken from their respective bores. Parallel fasteners would not experience the wedging phenomenon of the present invention, thus would tend to shake loose.

Although the present invention is shown accommodating only two fasteners, it may be configured to accommodate any number of fasteners at any number of angles insuring the security of the present invention on the mounting surface.

Referring to FIG. 2, the lower end 14 of the base 10 has a hook means or hook 50 with a lip 52. The hook 50 provides for maintaining a wire. The term "wire" is intended to embrace any means that conventionally is used for hanging a picture or framed article. The wire, thus the article, is maintained by the hook and may be removed therefrom.

Referring to FIG. 7, when the latch, having a distal end 54, is mounted on the base 10, and the distal end 54 is proximate to the lip 52, a closed capture zone 56 is defined. The term "proximate" means that the latch and base assume an orientation that discourages passage of a wire therebetween. The width of the passage is contingent on the wire or object intended to be secured.

The distinction between "maintaining" and "capturing" is important. "Maintaining" means that an article may be removed, whereas "capturing" means that an article is secured or rendered unremovable.

The present invention is not limited to permanently securing or capturing an article, rather selectably capturing the article. The term "selectable," as used herein, means that the user of the present invention may disable or defeat the securing properties of the feature. For example, if the present invention has captured a wire in the capture zone 56, the user may divert the distal end 54 of the latch 24 into the capture zone, thus providing a gap between the lip 52 and distal end 54 such that the wire may be withdrawn from the capture zone.

Referring again to FIGS. 1 and 2, the present invention includes a catch 58. Referring also to FIG. 7, the catch 58 serves as an added impediment to removing a wire from the capture zone 56. The catch 58 also allows a user to selectably enable the latch to cooperate with the base to capture a wire. As shown in FIGS. 6 and 7, the latch, here assuming a closed position, is enabled: a wire pressed against the latch and into the capture zone may be secured therein.

Figure 9:
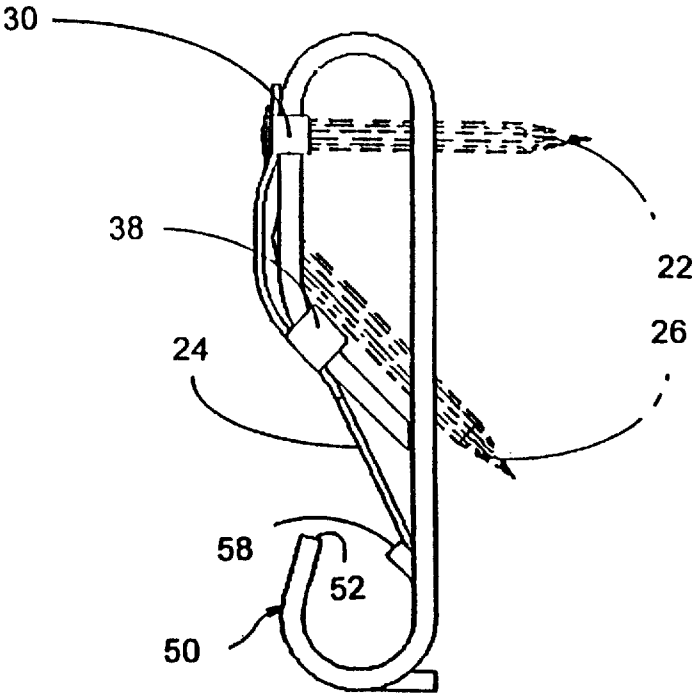
FIG. 9 is a right side elevational view of the embodiment shown in FIG. 8, the fastener shown in ghost lines for illustration purposes only.
Figure 8:
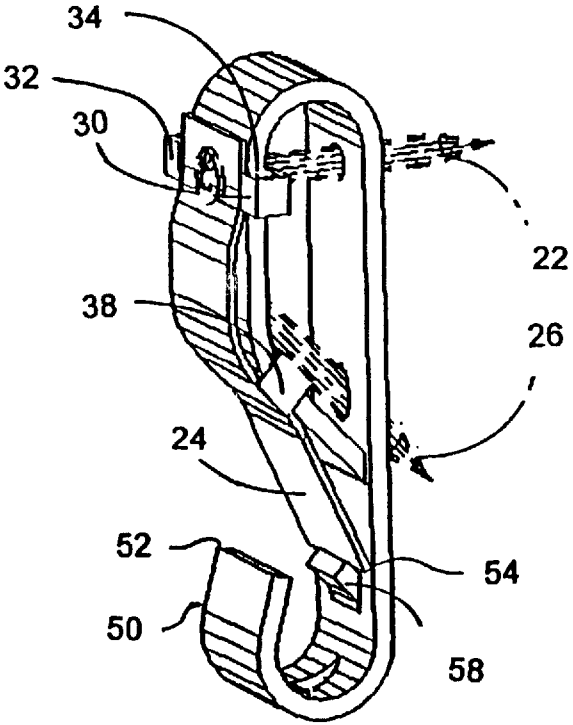
FIG. 8 is a top right front perspective view of the present invention including the latch, the fastener shown in ghost lines for illustration purposes only.

Referring to FIGS. 8 and 9, the catch 58 is shown retaining the distal end 54 of the latch 24 in the open position. This defeats the ability of the present invention to capture a wire, however permits a user to maintain a wire.

Although the ability of the present invention to capture an object may be disabled by the catch, the latch still provides for securing a fastener relative to the base. Thus, the base may be secured to a mounting surface, but is not restricted to only being able to capture a wire when secured.

The ability to defeat the latch from cooperating with the base to capture a wire means that this feature is selectable. As described above, the term "selectable" means that a user may disable or defeat the capturing element of the invention. In this example, the user may divert the distal end of the latch such that it is retained by the catch 58, such that the distal end 54 is unable to be proximate to the lip 52 of the hook 50.

Figure 10:
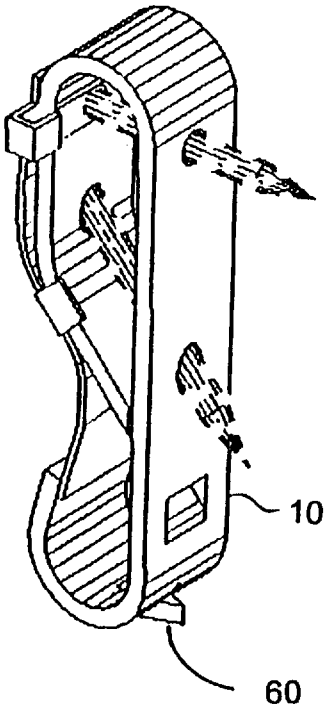
FIG. 10 is a top right rear prospective view of the embodiment shown in FIG. 8, the fastener shown in ghost lines for illustration purposes only.

Referring to FIG. 10, the present invention also includes means for marking a surface 60. The means for marking may include, but are not limited to an ink applicator, such as a felt-tip or ball point pen, a lead applicator, such as a pencil or chalk. The means for marking also may include an adhesive applicator which may apply appropriate indicia on the mounting surface. In this particular embodiment, the means for marking the surface 60 comprises a stamped-out, pointed extension or like impression-generator. This permits a user to snap the present invention onto the wire of an article to be hung, place the article in a desired location on a mounting surface and, by placing positive force against the invention, create a mark on the mounting surface. Once the mounting surface has been so marked, the user may remove the invention from the wire so that it may be fixed on the mounting surface.

The present invention is not intended to be limited to the embodiments described above, but to encompass any and all embodiments within the scope of the following claims.

I claim:

1. A mounting bracket comprising:

a base having a top portion, a back portion and a front portion depending from the top portion, the front portion having a free end, a first and a second aperture, extending through the front and back portions, which receive a first and a second fastener, respectively, a latch having an upper and lower edge, the latch contacting the base front portion and extending past the front portion free end, a first pair of side flaps extending from the latch, and said latch having a hole which receives said first fastener.

2. The mounting bracket according to claims 1, further comprising a second pair of side flaps extending from the latch for securing the latch to the base.

3. The mounting racket according to claim 1, wherein the first pair of side flaps are U-shaped.

4. The mounting bracket according to claim 1, further comprising extensions extending from the front portion where the first pair of side flaps overlie the front portion.

5. The mounting bracket according to claim 1, wherein the latch has an arcuate portion where it overlies the base first aperture.

6. The mounting bracket according to claim 1, wherein the first aperture is at an angle.

7. The mounting bracket according to claim 1, further comprising a catch extending from the base back portion for capturing the latch lower edge.

8. The mounting bracket according to clam 7, wherein the catch is struck from the base back portion.

9. The mounting bracket according to claim 1, further comprising a hook connected to the base back portion by an arcuate bottom portion.

10. The mounting bracket according to claim 1, wherein the base top portion is curved.

* * * * *